United States Patent [19]

Barr

[11] Patent Number: 4,593,777

[45] **Date of Patent: * Jun. 10, 1986**

[54] DRAG BIT AND CUTTERS

[75] Inventor: John D. Barr, Gloucestershire, England

[73] Assignee: NL Industries, Inc., New York, N.Y.

[ * ] Notice: The portion of the term of this patent subsequent to Dec. 17, 2002 has been disclaimed.

[21] Appl. No.: 578,183

[22] Filed: Feb. 8, 1984

Related U.S. Application Data

[63] Continuation-in-part of Ser. No. 468,669, Feb. 22, 1983, Pat. No. 4,558,753.

[51] Int. Cl.[4] ..... E21B 10/46

[52] U.S. Cl. ..... 175/379; 175/329; 175/410

[58] Field of Search ..... 175/329, 330, 410, 374, 175/379; 407/42, 33, 116, 118

[56] References Cited

U.S. PATENT DOCUMENTS

| | | | |
|---|---|---|---|
| 1,025,735 | 5/1912 | Bosredon | 407/118 X |
| 1,835,701 | 12/1931 | Edmunds | 299/79 |
| 4,057,294 | 11/1977 | Krekeler | 175/374 X |
| 4,108,260 | 8/1978 | Bozarth | 175/410 X |
| 4,200,159 | 4/1980 | Peschel et al. | 175/329 |
| 4,350,215 | 9/1982 | Radtke | 175/329 |
| 4,505,342 | 3/1985 | Barr et al. | 175/410 X |

*Primary Examiner*—James A. Leppink
*Assistant Examiner*—Hoang C. Dang
*Attorney, Agent, or Firm*—Browning, Bushman, Zamecki & Anderson

[57] ABSTRACT

A drill bit comprises a bit body having an operating end face. A plurality of self-sharpening cutters are mounted in the bit body and extend through the operating end face. The cutters have cutting faces adapted to engage an earth formation and cut the earth formation to a desired three-dimensional profile. The cutting faces define surfaces have back rake angles which decrease with distance from the profile. The individual cutting faces may be inwardly concave in a plane parallel to the intended direction of motion of the cutter in use. Each of the cutting members has a stud portion disposed in a respective recess in the bit body and defining the inner end of the cutting member, the cutting face being generally adjacent the outer end and having an outer cutting edge. The centerline of the stud portion is rearwardly inclined, from the outer end to the inner end, with respect to the direction of movement in use, taken at the midpoint of the cutting edge, at a first angle from 80° to 30° inclusive. The cutting face is oriented such that the tangent to the cutting face at the midpoint of the cutting edge and in the center plane of the cutting member is disposed at a second angle, for 18° to 75° inclusive, with respect to the centerline of the stud portion.

16 Claims, 15 Drawing Figures

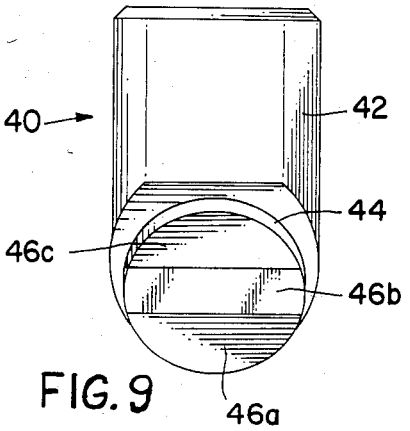
FIG. 9
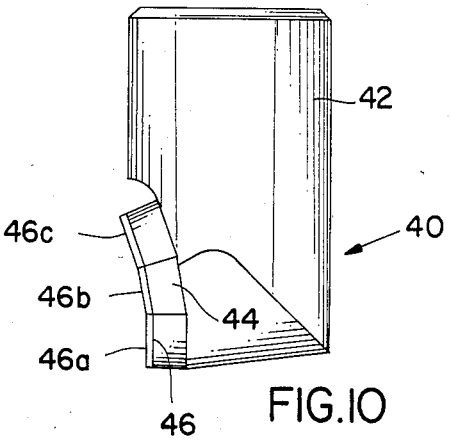
FIG. 10
FIG. 11
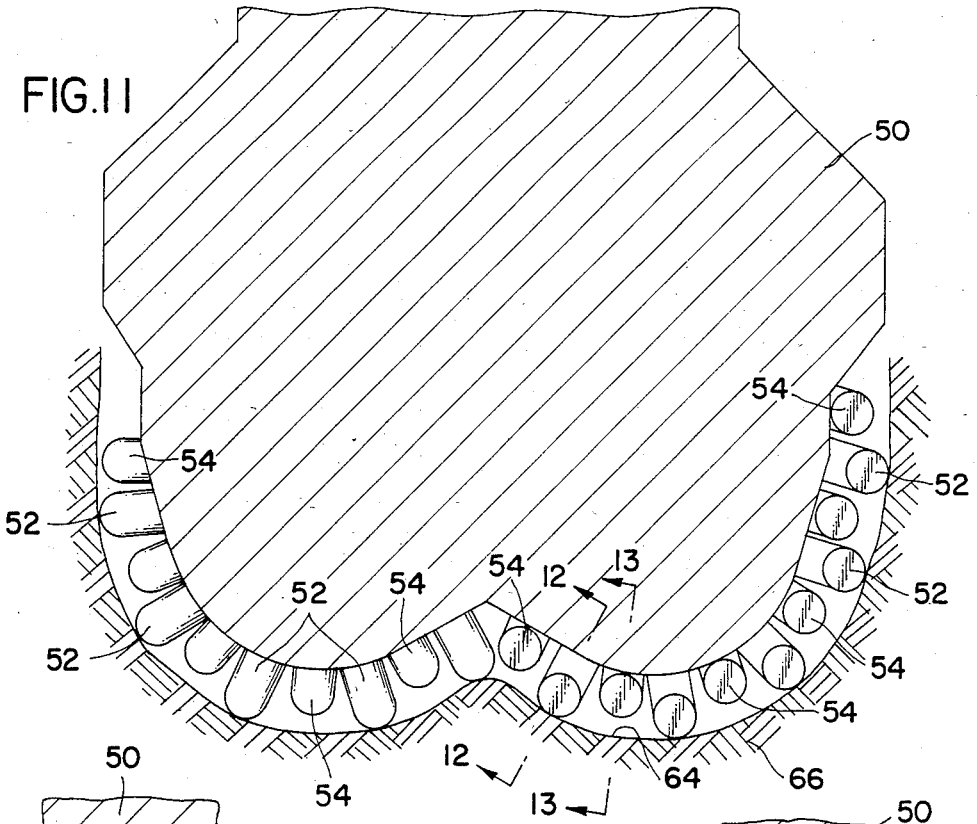
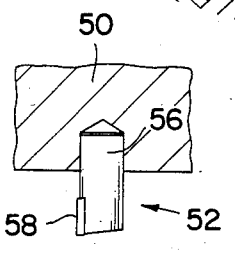
FIG. 12
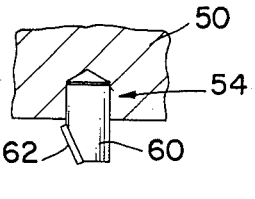
FIG. 13

DRAG BIT AND CUTTERS

CROSS-REFERENCE TO RELATED APPLICATION

This is a continuation-in-part of U.S. application Ser. No. 468,669, filed Feb. 22, 1983 now U.S. Pat. No. 4,558,753.

BACKGROUND OF THE INVENTION

The invention pertains to drag-type drill bits, and, more particularly, to the type of drag bit in which a plurality of cutting members are mounted in a bit body. Such cutting members are formed with a cutting face terminating in a relatively sharp cutting edge for engaging the earth formation to be drilled. In use, the cutting members wear. If the cutting members were formed of a single or uniform material, such wear would occur in a pattern which would cause the original sharp edge to be replaced by a relatively broad flat surface contacting the earth formation over substantially its entire surface area. Such flats are extremely undesirable in that they increase frictional forces, which in turn increases the heat generated and the torque and power requirements.

Accordingly, most such cutting members comprise a mounting body formed of one material and carrying a layer of substantially harder material which defines the cutting face. Typically, the mounting body is comprised of cemented tungsten carbide, while the layer defining the cutting face is comprised of polycrystalline diamond or other superhard material. Such use of layers of different materials renders the cutting members "self-sharpening" in the sense that, in use, the member will resist becoming blunt by tending to renew its cutting edge. The tungsten carbide material will tend to wear away more easily than the polycrystalline diamond material. This causes the development of a small step or clearance at the juncture of the two materials so that the earth formation continues to be contacted and cut substantially only by the edge of the diamond layer, the tungsten carbide substrate having little or no high pressure contact with the earth formation. Because the diamond layer is relatively thin, the edge thus maintained is sharp.

It has been found that the effectiveness of such cutting members and the bit in which they are employed can be improved by proper arrangement of the cutting members, and more specifically, their cutting faces, with respect to the body of the drill bit, and thus, to the earth formation being cut. The cutting faces are typically planar (although outwardly convex cutting faces are known). The cutting members can be mounted on the bit so that such planar cutting faces have some degree of side rake and/or back rake. Any given drill bit is designed to cut the earth formation to a desired three dimensional "profile" which generally parallels the configuration of the operating end of the drill bit. "Side rake" can be technically defined as the complement of the angle between (1) a given cutting face and (2) a vector in the direction of motion of said cutting face in use, the angle being measured in a plane tangential to the earth formation profile at the closest adjacent point. As a practical matter, a cutting face has some degree of side rake if it is not aligned in a strictly radial direction with respect to the end face of the bit as a whole, but rather, has both radial and tangential components of direction. "Back rake" can be technically defined as the angle between (1) the cutting face and (2) the normal to the earth formation profile at the closest adjacent point, measured in a plane containing the direction of motion of the cutting member, e.g. a plane perpendicular to both the cutting face and the adjacent portion of the earth formation profile (assuming a side rake angle of 0°). If the aforementioned normal falls within the cutting member, then the back rake is negative; if the normal falls outside the cutting member, the back rake is positive. As a practical matter, back rake can be considered a canting of the cutting face with respect to the adjacent portion of the earth formation profile, i.e. "local profile," with the rake being negative if the cutting edge is the trailing edge of the overall cutting face in use and positive if the cutting edge is the leading edge.

Substantial positive back rake angles have seldom, if ever, been used. Thus, in the terminology of the art, a negative back rake angle is often referred to as relatively "large" or "small" in the sense of its absolute value. For example, a back rake angle of −20° would be considered larger than a zero back rake angle, and a back rake angle of −30° would be considered still larger.

Proper selection of the back rake angle is particularly important in adapting a bit and its cutting members for most efficient drilling in a given type of earth formation. In soft formations, relatively small cutting forces may be used so that cutter damage problems are minimized. It thus becomes possible, and indeed preferable, to utilize a relatively small back rake angle, i.e. a very slight nagative rake angle, a zero rake angle, or even a slight positive rake angle, since such angles permit fast drilling and optimize specific energy. However, in hard rock, it is necessary to use a relatively large rake angle, i.e. a significant negative rake angle, in order to avoid excessive wear in the form of breakage or chipping of the cutting members due to the higher cutting forces which become necessary.

Problems arise in drilling through stratified formations in which the different strata vary in hardness as well as in drilling through formations which, while substantially comprised of relatively soft material, contain "stringers" of hard rock. In the past, one of the most conservative approaches to this problem was to utilize a substantially negative back rake angle, e.g. −20°, for the entire drilling operation. This would ensure that, if or when hard rock was encountered, it would be drilled without damage to the cutting members. However, this approach is unacceptable, particularly where it is known that a substantial portion, and specifically the uppermost portion, of the formation to be drilled is soft, because the substantial negative back rake angle unduly limits the speed of drilling in the soft formation.

Another approach, applicable where the formation is stratified, is to utilize a bit whose cutting members have smaller zero back rake angles to drill through the soft formation and then change bits and drill through the hard formation with a bit whose cutting members have larger back rake angles, e.g. −20° or more. This approach is unsatisfactory because of the time and expense of a special "trip" of the drill string for the purpose of changing bits.

If it is believed that the formation is uniformly soft, a somewhat daring approach is to utilize the relatively small back rake angle in order to maximize the penetration rate. However, if a hard stringer is encountered, catastrophic failures can result. For example, severe chipping of only a single cutting member increases the load on neighboring cutting members and shortens their life resulting in a premature "ring out," i.e. a condition in which the bit is effectively inoperative.

Another common problem is fracturing of the mounting body inwardly of the cutting face due to high operational forces.

SUMMARY OF THE INVENTION

In a bit according to the present invention, the cutting faces of the cutting members define surfaces having back rake angles which become more negative with distance from the earth formation profile. The terminology "more negative" is not meant to imply that the back rake angle closest to the profile is negative. Indeed, one of the advantages of the invention is that it makes the use of zero or slightly positive angles more feasible. Thus, the term is simply intended to mean that the values of the angles vary in the negative direction—with distance from the profile—whether beginning with a positive, zero or negative value.

This effect can be accomplished by at least two basic schemes. In one such scheme, there are at least two sets of cutting members, one set having its cutting faces disposed closer to the operating end face of the bit body than the cutting faces of the other set. The back rake angles of the cutting faces of the one or innermost set are more negative than the back rake angles of the cutting faces of the other or outermost set. As the bit begins to operate, only the outermost set of cutters, having the less negative back rake angles, will contact and cut the formation. Thus, the bit will be able to progress rapidly through the soft formation which is typically uppermost. If a hard stringer is encountered, or if the bit reaches the end of a soft stratum and begins to enter a hard stratum, the outermost set of cutters will quickly chip or break away so that the innermost set, having more negative rake angles, will be presented to the earth formation and begin drilling. This other set of cutters, with its relatively large rake angles, will be able to drill the hard rock without excessive wear or damage. If, subsequently, soft formation is again encountered, the second set of cutters can still continue drilling acceptably, albeit at a slower rate of speed than the first set.

A second basic scheme for providing the aforementioned varying rake angles is to form the cutting face of each individual cutting member so that it defines a number of different back rake angles from its outermost to its innermost edge. For example, the cutting face can define a curved concave surface, or a succession of planar surfaces or flats approximating such a curve. This scheme provides essentially all the advantages of the first scheme described above and, in addition, more readily provides a greater number of potential back rake angles. The system is self-adjusting in the sense that, when hard rock is encountered, the cutters will wear rapidly only to the point where they present a sufficiently negative back rake angle to efficiently cut the formation in question. At that point, the chipping or rapid wear will cease and the cutters will continue drilling the formation essentially as if their rake angles had been initially tailored to the particular type of rock encountered.

The use of such concave cutting faces on the individual cutting members has a number of other advantages, which can be further enhanced by complementary design features in the bit body. For example, the shape of the cutting faces may enhance the hydraulics across the operating end face of the bit and may also have a "chip breaker" effect. The bit body itself can be designed to further cooperate in the enhancement of the hydraulics as well as to provide maximum support for the cutting member adjacent to and opposite its cutting face.

Another advantage, particularly in those forms of the invention utilizing concave cutting faces on the individual cutting members, is that, in the event of severe wear, the extremely negative back rake angle which will be presented to the formation will effectively stop bit penetration in time to prevent the formation of junk by massive destruction of the bit.

It can readily be appreciated that the present invention can dramatically extend the life of a bit, or if extended life (or improved reliability) is not required, cost of manufacture can be reduced by providing fewer cutters on a bit to achieve the same life as a conventional bit.

Another aspect of the invention pertains to further improvements in the configuration of the individual cutting member, and its orientation with respect to the bit body. This aspect of the invention lessens the deleterious effects of the forces which are imposed on the cutting member in use. Although this aspect of the invention can be used alone, when further combined with the aforementioned aspects of the invention, most notably the use of the concave cutting face, the protection of the cutting member from damage is even further enhanced as the two aspects of the invention cooperate with each other, the curved face self-adjusting its own wear, and the lessening of the ill effects of the drilling forces further protecting the member generally.

The aforementioned cutting formation or cutting face terminates in an outermost cutting edge which actually engages the earth formation, and it is convenient, for present purposes, to measure the direction of movement at the midpoint of this cutting edge. During drilling, major forces are exerted on the outer end of the cutting member in two directions, upwardly generally normal to the earth formation, and rearwardly with respect to the direction of travel or movement as the bit is rotated. The resultant force thus has both upward and rearward components, and a vector representing the resultant force is inclined rearwardly and inwardly with respect to the bit.

The mounting body of the cutting member may be said to have a stud portion, being that portion of the mounting body which is directly engaged in the respective recess or pocket in the bit body. In accord with the present invention, the centerline of the stud portion is rearwardly inclined from the outer end to the inner end with respect to the direction of movement in use, taken at the midpoint of the cutting edge, at a first angle which may be from 80° to 30° inclusive, but even more preferably, from 65° to 50° inclusive. By this means, the stud portion is inclined generally in the same sense as the resultant of the aforementioned major forces. Accordingly, by an increase in the more tolerable compression force, the more dangerous bending and shear forces are reduced. This is highly instrumental in preventing breakage and failure of the cutting member.

Furthermore, by orienting the cutting face (more specifically the tangent to the cutting face at the midpoint of the cutting edge and in the central plane of the cutting member) at a second angle with respect to the stud centerline, which angle may be from 18° to 75° inclusive, but more preferably from 25° to 60° inclusive, desirable back rake angles may be provided while accommodating the aforementioned inclination of the stud portion.

Accordingly, it is a principal object of the invention to provide an improved drag-type drilling bit.

Another object of the present invention is to provide an improved, self-sharpening cutter for such a bit.

Still another object of the present invention is to provide such a bit wherein the cutting faces of the cutting members define surfaces having back rake angles which become more negative with distance from the earth formation profile.

A further object of the present invention is to provide an improved, self-sharpening cutter having an inwardly concave cutting face.

Yet another object of the present invention is to provide a drill bit and a cutting member therefor in which damage in use is minimized by the inclination of the stud portion of the cutting member in the bit body and/or the inclination of said stud portion with respect to the cutting face.

Still other objects, features and advantages of the present invention will be made apparent by the following detailed description, the drawings and the claims.

BRIEF DESCRIPTION OF THE DRAWINGS

FIG. 9 is a front elevational view of the third embodiment of cutting member.

FIG. 10 is a side elevational view of the cutting member of FIG. 9.

FIG. 11 is a schematic view of a bit according to another embodiment of the invention.

FIG. 12 is a detailed view of one of the first set of cutting members of the embodiment of FIG. 11 taken along line 12—12 thereof.

FIG. 13 is a detailed view of one of the second set of cutting members of the embodiment of FIG. 11 taken along line 13—13 thereof.

DETAILED DESCRIPTION OF THE PREFERRED EMBODIMENT

Figure 1:
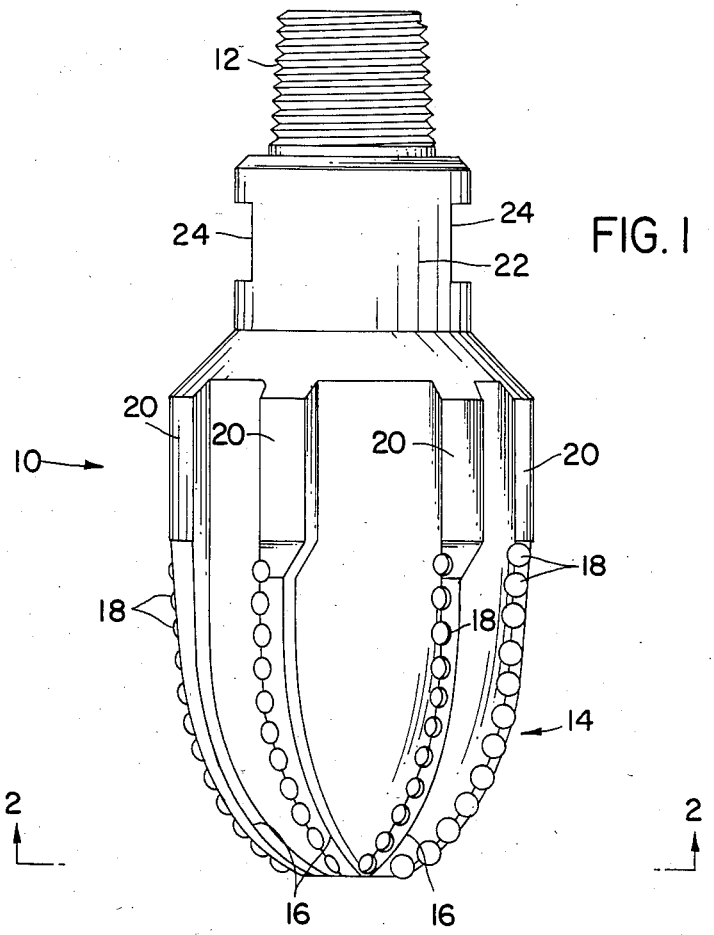
FIG. 1 is a side elevational view of a bit according to a first embodiment of the invention.
Figure 2:
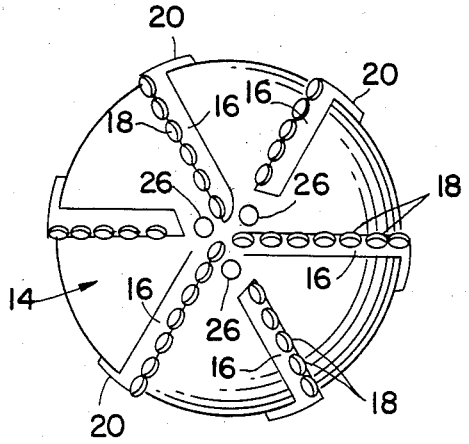
FIG. 2 is a plan view taken along the line 2—2 of FIG. 1.

FIGS. 1 and 2 depict a drill bit of the type in which the present invention may be incorporated. As used herein, "drill bit" will be broadly construed as encompassing both full bore bits and coring bits. Bit body 10, which is formed of tungsten carbide matrix infiltrated with a binder alloy, has a threaded pin 12 at one end for connection to the drill string, and an operating end face 14 at the opposite end. The "operating end face," as used herein includes not only the actual end or axially facing portion shown in FIG. 2, but contiguous areas extending up along the lower sides of the bit, i.e. the entire lower portion of the bit which carries the operative cutting members described hereinbelow. More specifically, the operating end face 14 of the bit is traversed by a number of upsets in the form of ribs or blades 16 radiating from the lower central area of the bit and extending across the underside and up along the lower side surfaces of the bit. Ribs 16 carry cutting members 18, to be described more fully below. Just above the upper ends of ribs 16, bit 10 has a gauge or stabilizer section, including stabilizer ribs or kickers 20, each of which is continuous with a respective one of the cutter carrying ribs 16. Ribs 20 contact the walls of the borehole which has been drilled by operating end face 14 to centralize and stabilize the bit and help control its vibration.

Intermediate the stabilizer section defined by ribs 20 and the pin 12 is a shank 22 having wrench flats 24 which may be engaged to make up and break out the bit from the drill string. Referring again to FIG. 2, the underside of the bit body 10 has a number of circulation ports or nozzles 26 located near its centerline, nozzles 26 communicating with the inset areas between ribs 16, which areas serve as fluid flow spaces in use.

Figure 3:
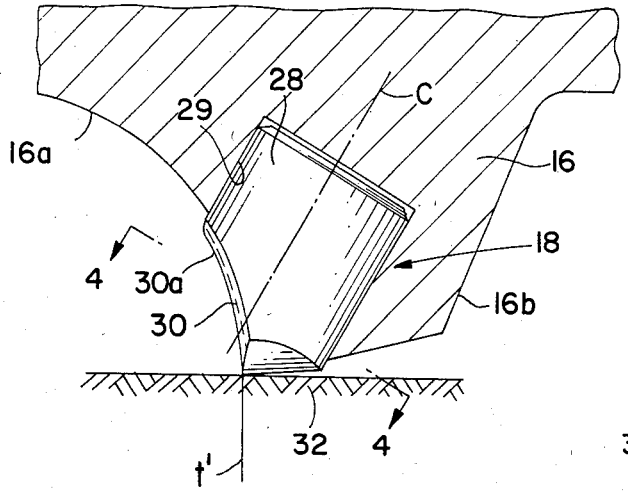
FIG. 3 is a detailed view, on a larger scale, showing a section through one of the ribs of the bit body with one of the cutting members shown in elevation.
Figure 4:
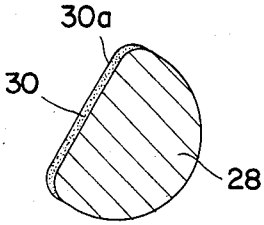
FIG. 4 is a detailed sectional view taken along the line 4—4 of FIG. 3.

Referring now to FIG. 3 in conjunction with FIGS. 1 and 2, bit body 10 is intended to be rotated in the counterclockwise direction, as viewed in FIG. 2. Thus, each of the ribs 16 has a leading edge surface **16*a* and a trailing edge surface 16*b*, as best shown in FIG. 3. As shown in FIGS. 3 and 4, each of the cutting members 18 is comprised of a mounting body 28—in the form of a post of cemented tungsten carbide, and a layer 30 of polycrystalline diamond or other superhard material carried on the leading face of the stud 28 and defining the cutting face 30*a* of the cutting member. As used herein, "superhard" will refer to materials significantly harder than silicon carbide, which has a Knoop hardness of 2470, i.e. to materials having a Knoop hardness greater than or equal to 2500. Each cutting member 18 has its mounting body 28 mounted in a respective recess 29 in one of the ribs 16 so that their cutting faces are exposed through the leading edge surfaces 16*a*. The portion of mounting body 28 immediately encased in recess 29** will be referred to herein as the "stud portion."

Layer 30, the underlying portion of body 28, and the cutting face defined by layer 30 are all inwardly concave in a plane in which their back rake angle may be measured, e.g. the plane of FIG. 3. As mentioned, cutting face **30*a* is exposed through the leading edge surface 16*a* of the respective rib 16 in which the cutting member is mounted and, in fact, cutting face 30*a* is the leading surface of the cutting member. As shown in FIG. 3, the curved cutting face 30*a* is a surface having a number of different back rake angles, which angles become more negative with distance from the profile of the earth formation 32, i.e. the angles become more negative from the outermost to the innermost edges of cutting face 30*a*. (As used herein, "distance" is measured from the closest point on the profile.) For example, the original outermost edge of face 30*a* forms the initial cutting edge in use. It can be seen that a tangent $t_1$ to surface 30***a* at its point of contact with the earth formation 32 is substantially coincident with a normal to that surface at the same point. Thus, the back rake angle at the original outermost edge or cutting edge of surface 30*a* is 0°.

Figure 6:
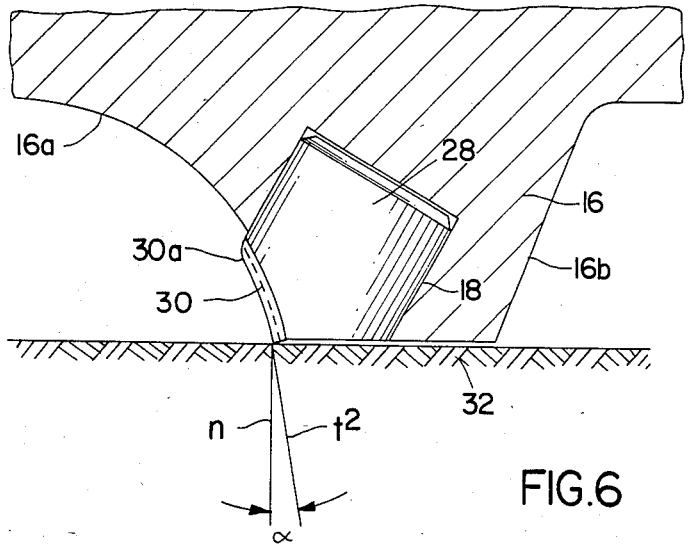
FIG. 6 is a view similar to that of FIG. 3 showing the adjustment to a lower back rake angle upon encountering hard rock.

FIG. 6 illustrates the same cutting member 18 and the associated rib 16 after considerable wear. The step formed between body 28 and layer 30 by the self-sharpening effect is shown exaggerated. It can be seen that, after such wear, the tangent $t_2$ to the cutting face 30*a* at its point of contact with the earth formation 32 forms an angle $\alpha$ with the normal n to the profile of the earth formation at that point of contact. It can also be seen that a projection of the normal n would fall within the cutting member 18. Thus, a significant back rake angle is now presented to the earth formation, and because the normal n falls within the cutting member, that angle is negative. More specifically, the back rake angle $\alpha$ is about −10° as shown.

In use, relatively soft formations may often be drilled first, with harder rock being encountered in lower strata and/or small "stringers." As drilling begins, the cutting member 18 is presented to the earth formation 32 in the configuration shown in FIG. 3. Thus, the operation portion of surface 30 has a back rake angle of approximately 0°. With such a back rake angle, the bit can drill relatively rapidly through the uppermost soft formation without substantial or excessive wear of the cutting members. If and when harder rock is encountered, the cutting member, including both the superhard layer 30 and the body 28 will wear extremely rapidly until the back rake angle presented to the earth formation is a suitable one for the kind of rock being drilled. For example, the apparatus may rapidly chip away until it achieves the configuration shown in FIG. 6, at which time the wear rate will subside to an acceptable level for the particular type of rock. Thus, the cutting member, with its varying back rake angles, is self-adjusting in the negative direction.

Having reached a configuration such as that shown in FIG. 6, with a relatively large negative back rake angle, suitable for the local formation, the cutting member 18 and the other cutting members on the bit, which will have worn in a similar manner, will then continue drilling the new hard rock without further excessive wear or damage. If, subsequently, soft formation is again encountered, the cutting members 18, even though worn to the configuration of FIG. 6 for example, can still continue drilling. Although they will not be able o drill at the fast rate permitted by the original configuration of FIG. 3, they will at least have drilled the uppermost part of the formation at the maximum possible rate, and can still continue drilling lower portions at a slower but nevertheless acceptable rate.

Thus, a bit equipped with cutters 18 will tend to optimize both drilling rate and bit life. The overall time for drilling a given well will be much less than if cutters with substantially negative back rake angles had been used at the outset. At the same time, there will be no undue expense due to a special trip to change from one drill bit to another as different types of formations are encountered. Likewise, there will be no danger of catastrophic failure as if cutters with small negative, zero or positive rake angles had been used throughout. It is noted, in particular, that if extreme wear is experienced, the surface 30*a* of the cutting member illustrated and the surfaces of the other similar cutting members on the bit will present such large negative back rake angles to the formation that bit penetration will be effectively stopped in time to prevent the formation of junk by massive damage.

The curvature of cutting face 30*a* has other advantages as well, particularly in concert with related design features of the overall cutting member 18 and the rib 16 in which it is mounted. As shown in FIGS. 3 and 4, cutting face 30*a*, while curved in the planes in which back rake angle can be measured, is not curved, but rather is straight, in perpendicular planes such as that of FIG. 4. More specifically, face 30*a* defines a portion of a cylinder. This permits the leading edge surface 16*a* of rib 16 to be formed so as to generally parallel the cutting face 30*a*, as well as additional cutting faces of other cutting members mounted in the same rib. This "blending" of the curvatures of the leading edge of the rib and the various cutting faces exposed therethrough improves the hydraulics of the drilling mud across the bit.

Figure 5:
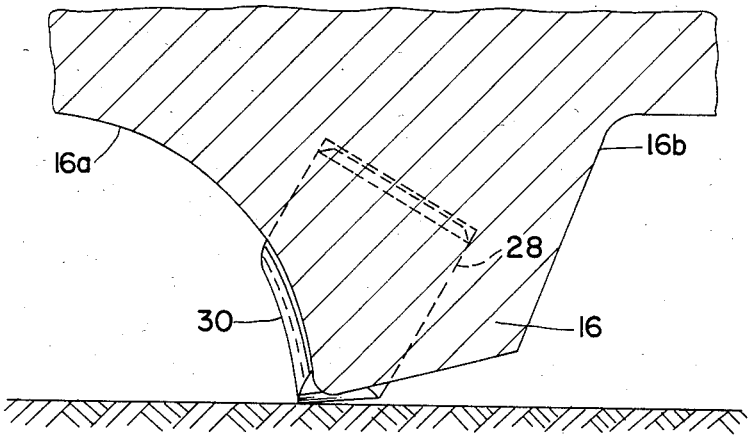
FIG. 5 is a view similar to that of FIG. 3 taken in a different plane.

Mounting body 28, being in the form of a peg-like stud, has a centerline C (FIG. 3) defining the longitudinal direction of the cutting member in general. Layer 30 and cutting face 30*a* defined thereby are laterally offset or eccentric with respect to the outermost end of body 28 on which they are carried. However, face 30*a* is intersected by centerline C as shown. This feature, together with the parallel curvature of face 30*a* and leading edge surface 16*a* of the respective rib allow for a maximum amount of support for the cutting member within the rib 16. As shown in FIG. 3, the portion of the body 28 generally opposite cutting face 30*a* is virtually completely embedded in and supported by the material of rib 16. As shown in FIG. 5, the lateral portions of the outermost end of stud 28 generally adjacent cutting face 30*a* are likewise substantially enveloped and supported by the material of rib 16. This substantial support helps to prevent damage to or loss of the cutting member in use. By comparison of FIGS. 3 and 5, it can be seen that almost the entirety of body 28 is embedded in and supported by rib 16, while at the ame time, the entirety of cutting face 30*a* is exposed for potential contact with the earth formation.

Still another advantage of the curved configuration of cutting face 30*a* is that it has a "chip breaker" effect. Briefly, if a chip of the earth formation begins to build up in front of cutting face 30*a*, the curvature of that face will tend to direct the forming chip up and over the cutting face, so that it breaks off and falls away, rather than accumulating on the leading side of the cutting face.

Figure 7:
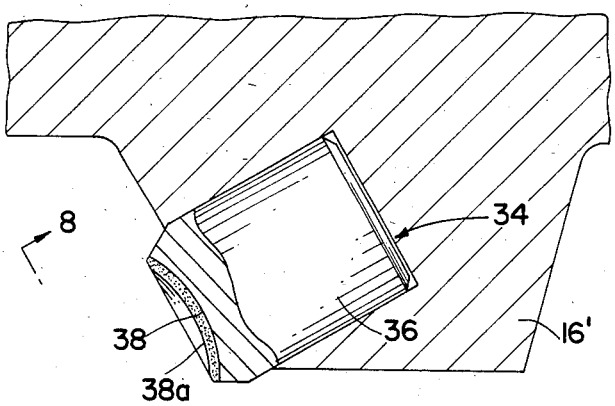
FIG. 7 is a view similar to that of FIG. 3 showing a second embodiment of cutting member.
Figure 8:
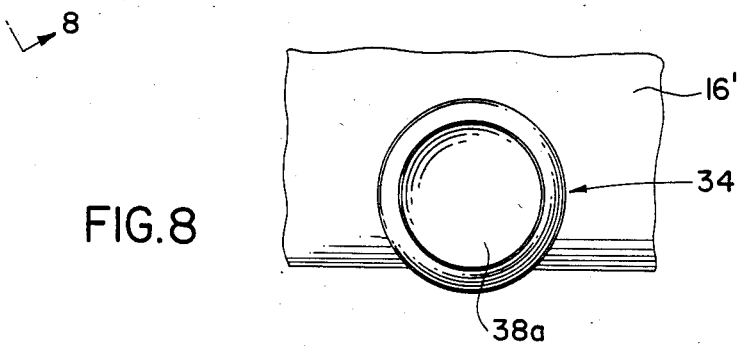
FIG. 8 is a view taken along the line 8—8 of FIG. 7.

Referring next to FIGS. 7 and 8, there is shown another form of cutting member which can be employed on a bit body similar to that shown in FIGS. 1 and 2. Like the cutting members 18 of the first embodiment, cutting member 34 of FIGS. 7 and 8 comprises a peg-like body 36 of sintered tungsten carbide forming the mounting body of the cutting member and a layer 38 of superhard material, such as polycrystalline diamond, carried on the outermost end of body 36 and forming the cutting face 38*a*. Likewise, cutting face 38*a* is curved so that it defines a plurality of back rake angles, becoming more negative with distance from the earth formation profile in use. However, unlike the layer 30 in the first embodiment, layer 38 in the embodiment of FIGS. 7 and 8 is arranged symmetrically on the end of body 36. Another difference is that layer 38 and the cutting face 38*a* which it defines are curved in transverse planes; more specifically, they define a portion of a sphere. FIG. 7 illustrates the manner in which the angle of mounting of the body 36 in a rib 16' of the bit body is varied (as compared to that of the preceding embodiment) to accommodate the symmetrical arrangement of layer 38 on body 36 and provide maximum rib support for the body while still allowing full exposure of cutting face 38*a*.

FIGS. 9 and 10 illustrate still another form of cutting member 40 according to the present invention. Member 40 includes a mounting body in the form of a post 42 of sintered tungsten carbide. Body 42 carries a layer 46 of superhard material, not directly, but by means of an intermediate carrier pad 44, also of sintered tungsten carbide. Layer 46 of superhard material and the cutting face which it defines are, as in the preceding embodiments, concave inwardly. However, rather than defining a single smooth curve, the cutting face comprises a succession of contiguous flats 46*a*, 46*b* and 46*c*, each disposed angularly with respect to the next adjacent flat or flats, and each defining a different, successively more negative back rake angle. Thus, the embodiment of FIGS. 9 and 10 includes a concave cutting face which approximates the curved cutting face of the first embodiment, but which defines only three back rake angles, rather than an infinite number of back rake angles.

Referring to FIGS. 11–13, there is shown a scheme by which certain principles of the present invention can be applied utilizing conventional cutting members having planar cutting faces. FIG. 11 diagrammatically illustrates a bit body 50 whose profile generally parallels the profile 64 of the earth formation 66 in use, in the conventional manner. Bit body 50 carries a first set of cutting members 54 and a second set of cutting members 52. The cutting members of the two sets are arranged alternately on the bit body. As best shown in FIG. 13, the cutting members 54 each comprise a mounting body 60 and a layer 62 of superhard material defining a planar cutting face. As shown in FIG. 12, each cutting member 52 likewise comprises a mounting body 56 and a layer 58 of superhard material defining a planar cutting face. However, the cutting members of the two sets differ in two basic respects. The members 54 of the first set have their cutting faces disposed closer to the operating end face of the bit body than the cutting faces of the second set of cutting members 52. As seen by comparison of FIGS. 12 and 13, the two sets also differ in that the first or innermost set has its cutting faces disposed at substantial negative back rake angles, while the first set of cutting members 52 has its cutting faces arranged at a back rake angle of 0°. Thus, although the individual cutting faces are planar, the cutting faces of the various cutting members on the bit body together define surfaces having back rake angles which become more negative with distance from the profile 64 of the earth formation 66.

Accordingly, in use, the bit of FIG. 11 will begin to drill in soft formation as shown in the drawing, with only the outermost cutting members 52 contacting and drilling the earth formation. These outermost cutting members have zero back rake angles suitable for rapidly drilling the uppermost soft formation. If and when hard rock is encountered, members 52 will rapidly break or chip away until members 54 are enabled to contact and begin drilling the earth formation. Because of their substantial negative back rake angles, members 54 will be able to drill the hard rock without excessive wear or damage.

Figure 14:
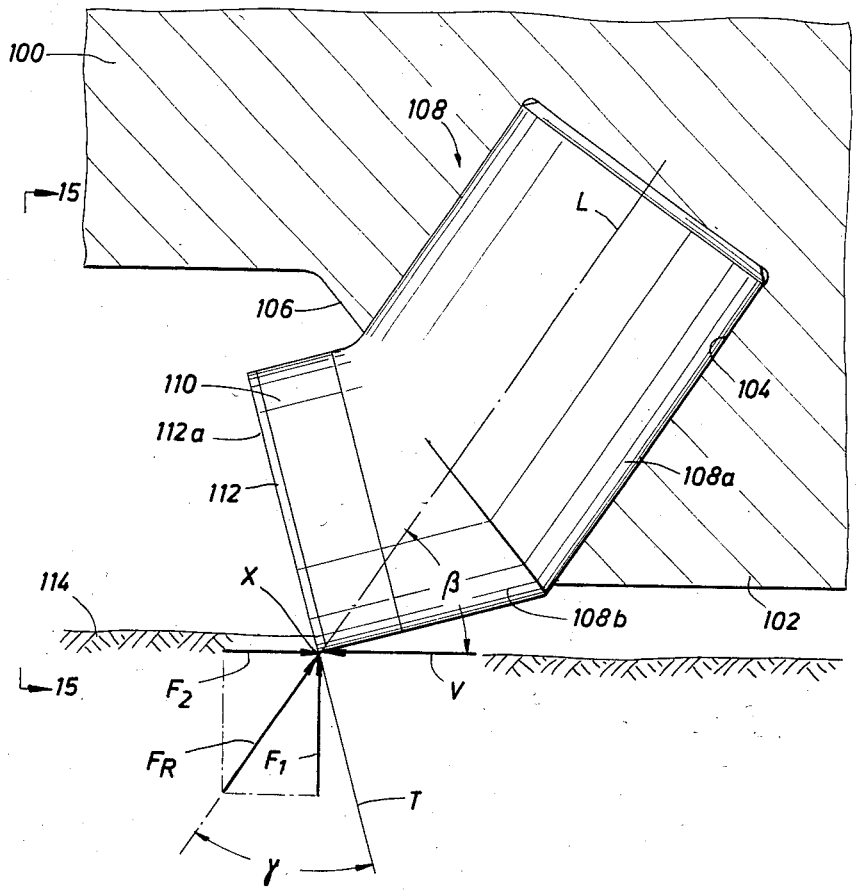
FIG. 14 is a detailed view of another embodiment, showing the cutting member in lateral side elevation and the adjacent portion of the bit body in section in the central plane of the cutting member.
Figure 15:
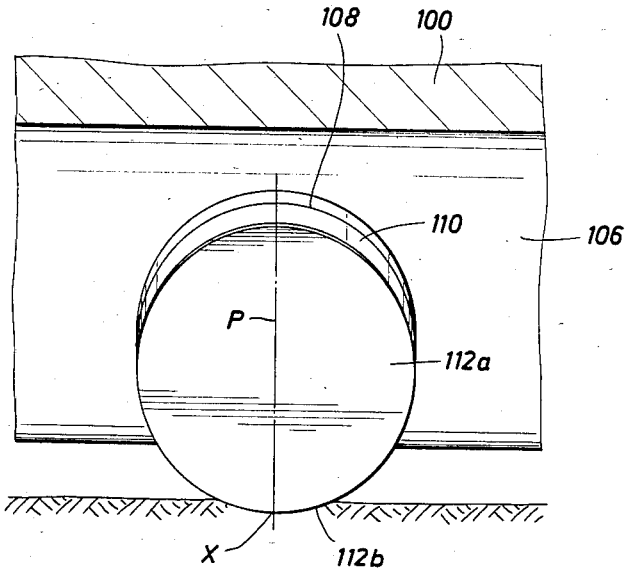
FIG. 15 is a front view taken along the line 15—15 in FIG. 14.

FIGS. 14 and 15 disclose another embodiment of cutting member and its relation to a bit body, along with vectors and construction lines useful in describing a further aspect of the present invention. In particular, there is disclosed a portion of a bit body 100 having on its operating end face an upset or rib 102 in which there is formed a pocket or recess 104. The mouth of recess 109 opens through the leading edge 106 of rib 102. It should be understood that the bit body 100 could otherwise be more or less similar to the bit body of FIGS. 1 and 2, and in particular, that rib 102 would have significant radial component of direction, that there would be other such ribs on the end face of the bit body, and that at least some of these ribs would have a number of recesses such as 104 therein.

FIGS. 14 and 15 further illustrate a cutting member comprising a mounting body 108 of sintered tungsten carbide, a carrier 110 also of sintered tungsten carbide, and a thin layer 112 of polycrystalline diamond material which defines a planar cutting formation or cutting face 112*a*, which in turn terminates in a cutting edge 112*b*. The mounting body 108 includes an innermost, generally cylindrical, stud portion 108*a* which is encased by and affixed within pocket 104. Stud portion 108*a* may be mounted in pocket 104 by interference fitting, particularly if the bit body 100 is of steel. Alternatively, particularly if a tungsten carbide matrix bit body is used, stud portion 108*a* may be brazed into pocket 104, in which case, for purposes of this description, the stud portion of the mounting body will still be considered to be in abutment with the walls of the pocket, even though there may be a thin layer of braze material therebetween.

Mounting body 108 further includes an outermost portion 108*b* which is angularly oriented with respect to stud portion 108*a*. Carrier 110 is affixed to the outer end surface of portion 108*b*, and cutting layer 112 is in turn affixed to the outer surface of carrier 110.

As the cutting edge 112*b* of the cutting face 112*a* engages and cuts the earth formation 114 in use, the travel or movement caused by rotation of the bit defines a forward direction. The direction of travel for all points on the cutting face will be parallel or nearly parallel, depending upon the configuration of the cutting face, but for purposes of precise definition in this description, reference will be made to the direction of travel of the midpoint X of the cutting edge 112*b*. Point X lies in the central plane P of the cutting member, which plane also passes through the centerline L of stud portion 108*a* and bisects the cutting member into two identical symmetrical halves. The direction of travel of point X is indicated by vector V.

As the cutting edge 112*b* engages and cuts the earth formation 114, high forces are exerted on the cutting member in two major directions. Due to the weight of the drill string bearing down on the bit and its cutting members, there is a force $F_1$ exerted generally upwardly normal to the earth formation. Due to the forward travel of the cutting edge 112*b* and its scraping against the earth formation 114, there is a force $f_2$ exerted in a rearward direction. The resultant of the two forces is represented by the vector $F_R$ which is inclined upwardly (i.e. inwardly with respect to the bit) and rearwardly.

In accord with the present invention, the centerline L of stud portion 108*a* and its mating pocket 104 are likewise rearwardly inclined, with respect to the direction of travel or movement V, from the outer to the inner end of the stud portion, at a first angle $\beta$. (In this specification, unless otherwise noted, the angle between two lines will be considered to be the smaller of two complementary angles formed by the intersection of those lines.)

By virtue of such inclination at angle $\beta$, the bending and shear effects of force $F_R$ are decreased while its compressive effect is increased. Although the exact inclination of vector $F_R$ may vary during use of the bit, it will, for reasons previously explained, always be rearwardly and inwardly inclined. Thus, if the inclination of line L with respect to vector V is likewise rearward and inward, the cutting member will always be placed more in compression and less in shear, as compared to prior art arrangements wherein the stud portions of the mounting bodies were disposed generally normal to the profile of the earth formation.

Furthermore, the cutting face 112*a* is inclined with respect to centerline L of stud portion 108*a*, at a second angle, which preferably differs from the angles utilized in standard or conventional cutting members. Because the cutting face 112*a* as illustrated is planar, the aforementioned second angle is constant for all points on the cutting face for the particular embodiment shown. However, again for purposes of specific and accurate definition, and to account for variations in which the cutting face might be curved as described above, reference will be had to a second angle $\gamma$ betwen the centerline L and a tangent T to cutting face 112*b* taken at point X and in the central plane P.

By suitable choice and correlation of the first and second angles $\beta$ and $\gamma$, it is possible to place the cutting member as much in compression as possible, utilizing educated estimates of the direction of the average resultant force $F_R$, while at the same time, providing desirable back rake angles of cutting face 112*a*.

For accomplishing the two aforementioned purposes, i.e. of placing the cutting member more nearly in compression in use while also providing a desirable back rake angle, the first angle $\beta$ should preferably be kept within a range of 80° to 30° inclusive, and even more preferably, from 65° to 50° inclusive. The second angle $\gamma$ should preferably be kept within a range of 18° to 75° inclusive, and even more preferably, a range of 25° to 60° inclusive. Popular back rake angles for planar cutting faces are −20°, −10° and 0°. If the back rake angle is to be approximately −20°, second angle $\gamma$ should be from 38° to 75° inclusive, and even more preferably, from 45° to 60° inclusive. If the back rake angle is to be −10° or thereabouts, $\gamma$ should be from 28° to 65° inclusive, and more preferably, from 35° to 50° inclusive. If the back rake angle is to be approximately 0°, $\gamma$ should be from 18° to 55° inclusive, and more preferably from 25° to 40° inclusive.

Where the cutting face is curved or otherwise concave, as described hereinabove, the back rake angle changes with distance from the earth formation profile. Thus, for purposes of the above parameters on angle $\gamma$, with such concave cutting faces, it is convenient to refer to the back rake angle at the existing cutting edge. As the cutting member wears in use, the location of the cutting edge, and thus the back rake angle of the cutting edge, will change. However, during normal operation, drilling will be terminated when such wear has progressed inwardly, at most, half way across the cutting face. By appropriate choices of the angle $\gamma$ with respect to the original cutting edge when the cutting member is new, it is possible to maintain the angle $\gamma$ within the desired range of 18° to 75° inclusive, and even the more preferable range of 25° to 60° inclusive, for at least a major portion of the anticipated cutter life.

Referring still to FIGS. 14 and 15, and comparing those two figures, it can be seen that the preferred choices of angles $\beta$ and $\gamma$ have been utilized while still providing substantial back support and lateral support for the cutting member. In particular, it can be seen that substantial bit body material within the rib or upset 102 backs or lies rearwardly of the cutting face 112*a* over a major portion of the extent of that cutting face. Referring once again to FIG. 3, by eliminating the angular portion (108*b*) of the mounting body, while allowing the recess 29 to open partially through the outer surface of the rib 16 as well as through its leading end surface 16*a*, a wide range of angles $\beta$ and $\gamma$ can be accommodated while providing an even greater degree of surrounding of the outer end of the mounting body 28 by the material of the bit body.

The foregoing represent only a few exemplary embodiments of the present invention, and it will be understood that many modifications may suggest themselves to those of skill in the art. For example, in addition to the cylindrical and spherical cutting faces illustrated in the first two embodiments above, other concave curves such as toroidal or elipsoidal curves are possible as well as variable curves defining no standard geometrical form. Schemes similar to that of FIG. 11 may involve other arrangements of the large and small rake angle cutters on the bit body. For example, rather than providing both types of cutters on each row, alternate rows may be provided with large and small rake angle cutters respectively. The appropriate spacing of the various rows from the profile could be achieved by forming ribs or blades on the bit body, as in FIGS. 1 and 2, but with alternate ribs having different thicknesses.

The materials may be varied, but in any event, it is preferred that the material of the mounting bodies be significantly harder than that of the bit body, and that the material of the cutting faces be even harder, more specifically "superhard" as defined hereinabove.

Still other variations are possible. Accordingly, it is intended that the scope of the invention be limited only by the claims which follow.

What is claimed is:

1. A drag-type drill bit comprising:

a bit body adapted for rotative movement in a predetermined direction in use and having an operating end face;

and a plurality of self-sharpening cutting members mounted in said bit body and adapted to cut an earth formation to a desired three-dimensional profile, each of said cutting members having a stud portion disposed in a respective recess in said bit body and defining the inner end of said cutting member, and a cutting face generally adjacent its outer end facing outwardly through said end face of said bit body and terminating in an outermost cutting edge having a midpoint, the centerline of said stud portion being rearwardly inclined from said outer end to said inner end with respect to said direction of movement in use—taken at the midpoint of said cutting edge—at a first angle from 80° to 30° inclusive;

and said cutting face being oriented such that the tangent to said cutting face at the midpoint of said cutting edge and in the central plane of the cutting member, is disposed at a second angle, from 18° to 75° inclusive, with respect to the centerline of said stud portion;

said cutting faces defining surfaces having back rake angles which become more negative with distance from said profile.

2. The apparatus of claim 1 wherein said cutting face has a back rake angle at said cutting edge of about −20°, and wherein said second angle is from 38° to 75° inclusive.

3. The apparatus of claim 1 wherein said cutting face has a back rake angle at said cutting edge of about −10°, and wherein said second angle is from 28° to 65° inclusive.

4. The apparatus of claim 1 wherein said cutting face has a back rake angle at said cutting edge of about 0°, and wherein said second angle is from 18° to 55° inclusive.

5. The apparatus of claim 1 wherein said first angle is from 65° to 50° inclusive, and wherein said second angle is from 25° to 60° inclusive.

6. The apparatus of claim 5 wherein said cutting face has a back rake angle at said cutting edge of about −20°, and wherein said second angle is from 45° to 60° inclusive.

7. The apparatus of claim 5 wherein said cutting face has a back rake angle at said cutting edge of about −10°, and wherein said second angle is from 35° to 50° inclusive.

8. The apparatus of claim 5 wherein said cutting face has a back rake angle at said cutting edge of about 0°, and wherein said second angle is from 25° to 40° inclusive.

9. A bit according to claim 1 wherein each of said cutting faces has a plurality of back rake angles which become more negative with distance from said profile.

10. A bit according to claim 9 wherein each of said cutting faces defines a concave curve in the plane of measurement of said back rake angles.

11. A bit according to claim 10 wherein the configuration of said operating end face defines a plurality of upsets each having a leading edge surface; wherein said stud portions of said cutting members are embedded in said upsets to mount said cutting members so that said cutting faces are exposed along said leading edge surfaces.

12. A bit according to claim 11 wherein the portion of each of said mounting bodies opposite said cutting face and lateral portions of said mounting body adjacent said cutting face are substantially embedded in and supported by the respective one of said upsets.

13. A bit according to claim 10 wherein each of said cutting faces defines a portion of a cylinder.

14. A drag-type drill bit comprising:

a bit body adapted for rotative movement in a given direction in use and having an operating end face;

and a plurality of self-sharpening cutting members mounted in said bit body and adapted to cut an earth formation to a desired three-dimensional profile, each of said cutting members having a stud portion disposed in a respective recess in said bit body and defining the inner end of said cutting member, and a cutting face generally adjacent the outer end of said cutting member, facing outwardly from said end face of said bit body, and defining an outermost cutting edge having a midpoint;

the centerline of said stud portion being rearwardly inclined from the outer end to the inner end of said cutting member with respect to said direction of movement in use—taken at the midpoint of said cutting edge—at an angle from 65° to 50° inclusive;

said cutting faces defining surfaces having back rake angles which become more negative with distance from said profile.

15. A bit according to claim 14 wherein each of said cutting faces has a plurality of back rake angles which become more negative with distance from said profile.

16. A bit according to claim 15 wherein each of said cutting faces defines a concave curve in the plane of measurement of said back rake angles.

* * * * *